73-151
6/10/86 OR 4,593,559

United States Patent [19]
Brown et al.

[11] Patent Number: 4,593,559
[45] Date of Patent: Jun. 10, 1986

[54] APPARATUS AND METHOD TO COMMUNICATE BIDIRECTIONAL INFORMATION IN A BOREHOLE

[75] Inventors: David C. Brown, Los Osos; Harold J. Engebretson, Yorba Linda; Fred L. Watson, Templeton, all of Calif.

[73] Assignee: Applied Technologies Associates, San Marino, Calif.

[21] Appl. No.: 709,430

[22] Filed: Mar. 7, 1985

[51] Int. Cl.[4] ..... E21B 47/022
[52] U.S. Cl. ..... 73/151; 33/312
[58] Field of Search ..... 73/151; 367/81; 33/304, 33/312; 364/422

[56] References Cited

U.S. PATENT DOCUMENTS

| | | | |
|---|---|---|---|
| 2,309,905 | 2/1943 | Irwin et al. . | |
| 2,635,349 | 4/1953 | Green . | |
| 2,674,049 | 4/1954 | James, Jr. . | |
| 2,681,567 | 6/1954 | Widess . | |
| 2,806,295 | 9/1957 | Ball . | |
| 3,037,295 | 6/1962 | Roberson . | |
| 3,137,077 | 6/1964 | Rosenthal . | |
| 3,229,533 | 1/1966 | Draper et al. | 74/5.4 |
| 3,241,363 | 3/1966 | Alderson et al. | 73/178 |
| 3,242,744 | 3/1966 | Fischel . | |
| 3,308,670 | 3/1967 | Granqvist | 74/5.34 |
| 3,561,129 | 2/1971 | Johnston | 33/226 |
| 3,587,175 | 6/1971 | Armistead . | |
| 3,753,296 | 8/1973 | Van Steenwyk | 33/304 |
| 3,808,697 | 5/1974 | Hall | 33/312 |
| 3,845,569 | 11/1974 | Otte et al. | 33/312 |
| 3,862,499 | 1/1975 | Isham et al. | 33/312 |
| 3,894,341 | 7/1975 | Kapeller | 33/324 |
| 4,071,959 | 2/1978 | Russell et al. | 33/318 |
| 4,174,577 | 11/1979 | Lewis | 33/302 |
| 4,192,077 | 3/1980 | Van Steenwyk et al. | 33/313 |
| 4,197,654 | 4/1980 | Van Steenwyk et al. | 33/304 |
| 4,199,869 | 4/1980 | Van Steenwyk | 33/302 |
| 4,238,889 | 12/1980 | Barriac | 33/304 |
| 4,244,116 | 1/1981 | Barriac | 33/304 |
| 4,245,498 | 1/1981 | Poquette, Jr. | 73/151 |
| 4,265,028 | 5/1981 | Van Steenwyk | 33/304 |
| 4,297,790 | 11/1981 | Van Steenwyk et al. | 33/313 |
| 4,302,886 | 12/1981 | Starr | 33/313 |
| 4,433,491 | 2/1984 | Ott et al. | 33/302 |
| 4,459,760 | 7/1984 | Watson et al. | 33/312 |
| 4,461,088 | 7/1984 | Van Steenwyk | 33/304 |
| 4,464,660 | 8/1984 | Ginn | 73/151 X |
| 4,468,863 | 9/1984 | Van Steenwyk | 33/304 |
| 4,471,533 | 9/1984 | Van Steenwyk et al. | 33/302 |
| 4,472,884 | 9/1984 | Engebretson | 33/304 |

FOREIGN PATENT DOCUMENTS

| | | |
|---|---|---|
| 999735 | 11/1976 | Canada . |
| 1108892 | 9/1981 | Canada . |
| 1123237 | 5/1982 | Canada . |
| 7330189 | 3/1975 | France . |
| 7930863 | 7/1980 | France . |
| 1437125 | 5/1976 | United Kingdom . |
| 2027904 | 2/1980 | United Kingdom . |
| 2039371 | 8/1980 | United Kingdom . |
| 2111216 | 6/1983 | United Kingdom . |

*Primary Examiner*—Jerry W. Myracle
*Attorney, Agent, or Firm*—William W. Haefliger

[57] ABSTRACT

The invention relates generally to mapping or survey apparatus and methods, and more particularly concerns efficient transmission of survey signals or data from depth level in a borehole or well to the well surface, for analysis, display or recordation; further it concerns efficient transmission of command data from a surface computer unit to the survey tool at depth level in a borehole or well for control of instrumentation operating modes, operating characteristics, or diagnostic purposes; and further it concerns supply of DC power downwardly to the instrumentation via a wireline by which such command signal and survey data or signals may be transmitted upwardly or downwardly respectively.

11 Claims, 12 Drawing Figures

FSK RECEIVER
FSK MODULATOR
POWER SUPPLY
RETURN
GND
OUT
A
TOOL POWER SUPPLY
C
L1
WIRE LINE
B
CURRENT SELECT
M
L
K
J
H
G
F
TRANSFORMER
AC1
CT
AC2
UNREG V+
+12V
-12V
IN
OUT
U5
U3
U4
U6
U1
U7
U11
U12
U13
U14
VR1
VR2
R4
R5
R6
R7
R8
R17
R18
R19
R20
R21
R22
R23
R24
R25
R26
R27
R30
R31
R32
R37
R38
R39
R40
R41
C1
C3
C11
C12
C13
C14
C15
C16
C18
C19
C20
C21
CR1
CR2
CR3
CR4
CR5
CR6
CR7
CR8
Q1
Q2
Q3
J1
J2

APPARATUS AND METHOD TO COMMUNICATE BIDIRECTIONAL INFORMATION IN A BOREHOLE

BACKGROUND OF THE INVENTION

The invention relates generally to mapping or survey apparatus and methods, and more particularly concerns efficient transmission of survey signals or data from depth level in a borehole or well to the will surface, for analysis, display or recordation; further it concerns efficient transmission of command data from a surface computer unit to the survey tool at depth level in a borehole or well for control of instrumentation operating modes, operating characteristics, or diagnostic purposes; and further it concerns supply of DC power downwardly to the instrumentation via a wireline by which such command signals and survey data or signals may be transmitted upwardly or downwardly respectively.

U.S. Pat. No. 4,459,760 discloses apparatus and methods to transmit sensor data as further disclosed in U.S. Pat. Nos. 3,753,296 and U.S. Pat. No. 4,199,869 that concern the use of angular rate sensors and acceleration sensors in boreholes to derive data usable in determination of borehole azimuth $\psi$ and tilt $\phi$. However, those patents only refer to data transmission in an upward direction in a borehole. U.S. Pat. No. 4,468,863 discloses a method for bidirectional transmission over the wireline so that survey tool operating modes and other characteristics may be altered from the surface when the survey tool is at depth in the well or borehole, however, that patent does not specifically disclose how such data can be communicated to and from the surface of a well, in usable form, and with the unusual advantages of the simple, effective and reliable communication system as disclosed herein.

SUMMARY OF THE INVENTION

It is a major object of the invention to provide a data communication and method and system of simple, effective, reliable, and improved form, for use in a borehole environment, as will appear. Basically, the system includes:

(a) means for suspending said instrumentation in the borehole, (b) said instrumentation operating to generate analog signals in the borehole, (c) means responsive to reception of said signals for multiplexing said signals and converting same to digital signals, in the borehole, (d) means responsive to reception of said digital signals for converting said digital signals to digital signal words, (e) means in the borehole connected to receive said signal words and produce signal versions thereof for transmission to the surface, (f) a transmission path operatively connected with said (e) means, for transmitting said signal versions upwardly in the borehole, (g) means for stripping said signal versions off the transmission path at an upper elevation and processing said signal versions to a form usable in determination of borehole azimuth and/or tilt at the level of said instrumentation in the borehole, (h) means to generate digital command words, (i) means at an upper location connected to receive said digital command words and produce signal versions thereof for transmission ownwardly in the borehole, to said instrumentation, (j) a transmission path for transmitting said command signals to the survey tool, (k) means for stripping said command signal versions off the (j) transmission path and processing said signal versions to form usable command words for use by said instrumentation in the borehole to control operating modes and other operating characteristics of said instrumentation.

As will be seen, the wireline also transmits power (such as DC power) from a source at the well head to the instrumentation suspended in the borehole; and the instrumentation may include one or more of the following:

(i) angular rate sensor means and acceleration sensor means operated to produce the analog signals and useful in determination of borehole azimuth or tilt;

(ii) temperature sensor means operated to produce the analog signals;

(iii) tubing or pipe collar locater means operated to generate the analog signals as such means is raised or lowered in the borehole.

Typically, the survey method employs apparatus as referred to, with first means for measuring angular rate, and second means for sensing tilt, and a rotary drive for the first and second means, the basic steps of the method including:

(a) operating the drive and the first and second means at a first location in the borehole to determine the azimuthal direction of tilt of the borehole at such location, (b) then traveling the first and second means and the drive lengthwise of the borehole away from that location, and operating the drive and at least one of the first and second means during such traveling to determine changes in borehole alignment during traveling, (c) said (a) and (b) steps carried out while the signal versions are passed upwardly and downwardly in the borehole.

Apparatus embodying the survey tool may advantageously comprise:

($N_1$) first sensor means for measuring angular rate about one or more axes, ($N_2$) second sensor means for sensing tilt or acceleration along one or more axes, ($N_3$) rotary drive mens for rotating and controlling said first and second means in the borehole, and ($N_4$) circuit means operatively connected between said second means and rotary drive means for:

(i) allowing the drive to rotate the first and second means at a first location in the borehole to determine the azimuthal direction of tilt of the borehole at said location, and (ii) causing the drive to maintain an axis defined by said second means at a predetermined orientation relative to horizontal during traveling of the apparatus in the borehole, whereby at least one of the first and second means may be operated during such traveling to determine changes in borehole alignment along the borehole length. These and other objects and advantage of the invention, as well as the details of an illustrative embodiment, will be more fully understood from the following specification and drawings, in which:

DRAWING DESCRIPTION

Figure 1:
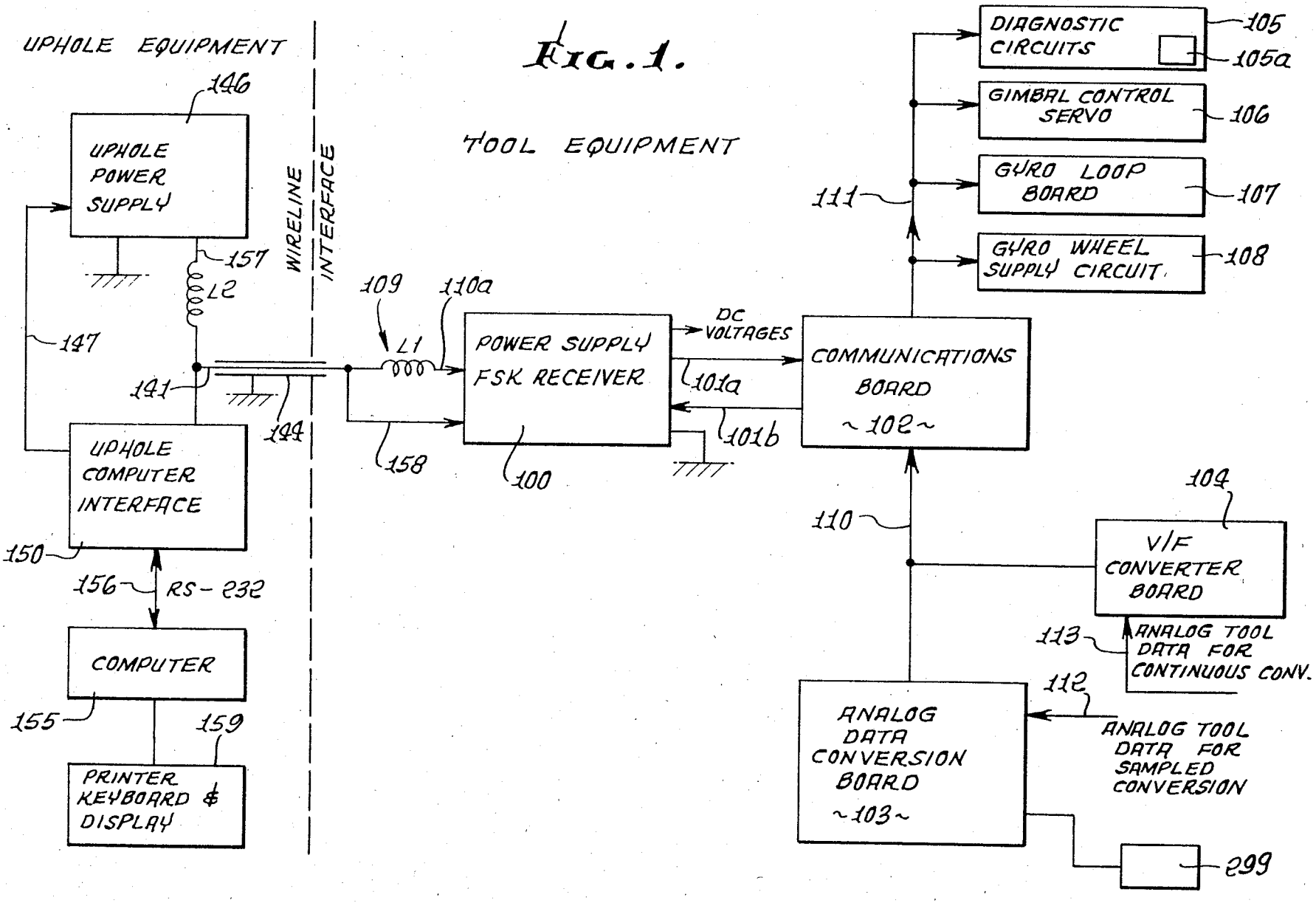
FIG. 1 is a circuit block drawing of a communications system, embodying the invention.
Figure 9:
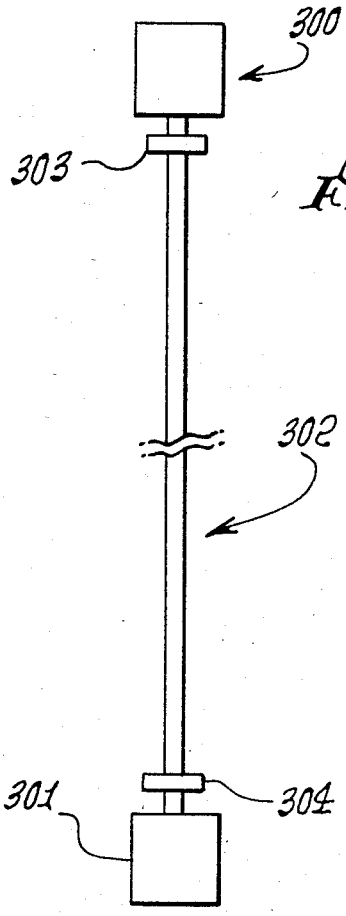
Figure 4A:
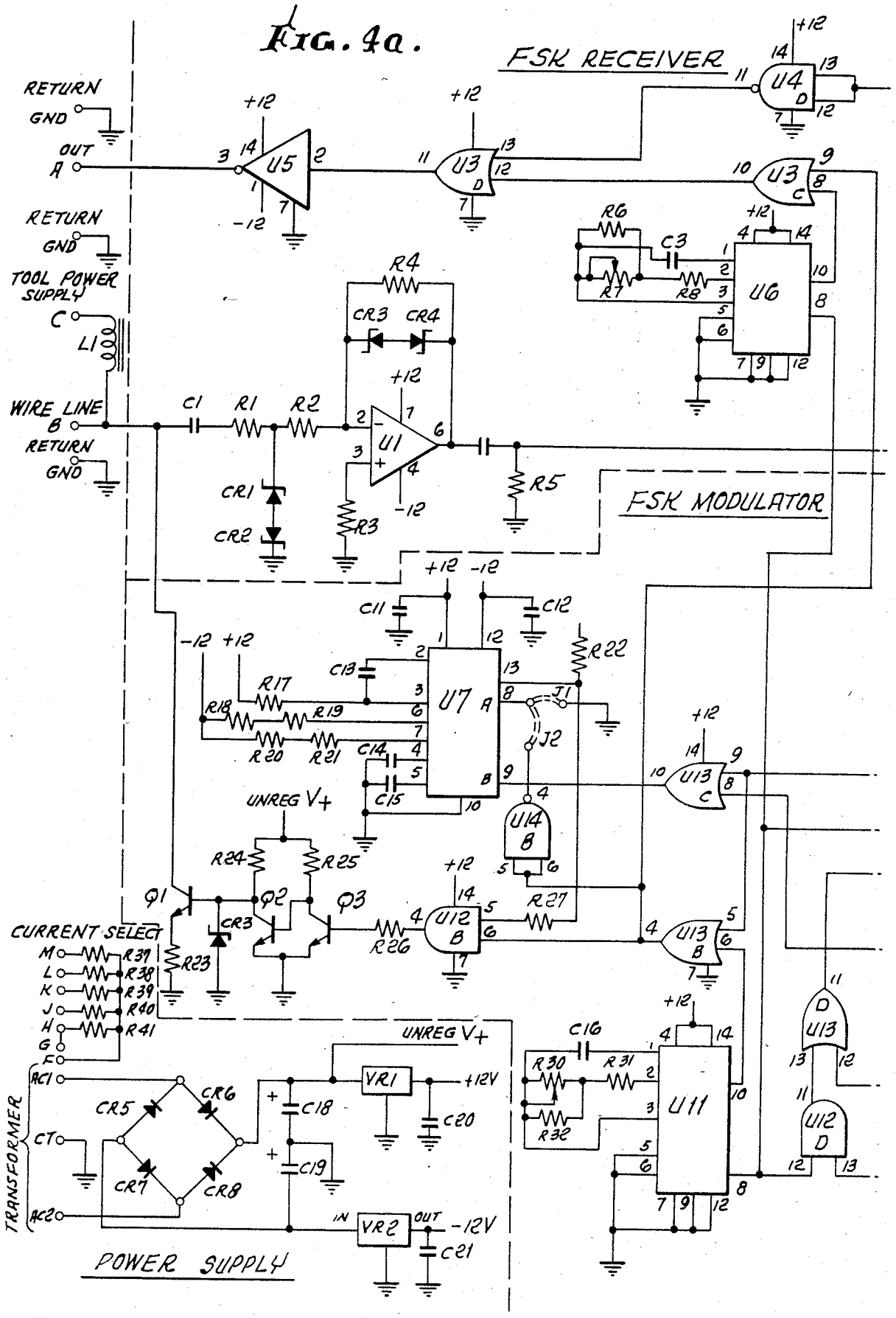
Figure 4B:
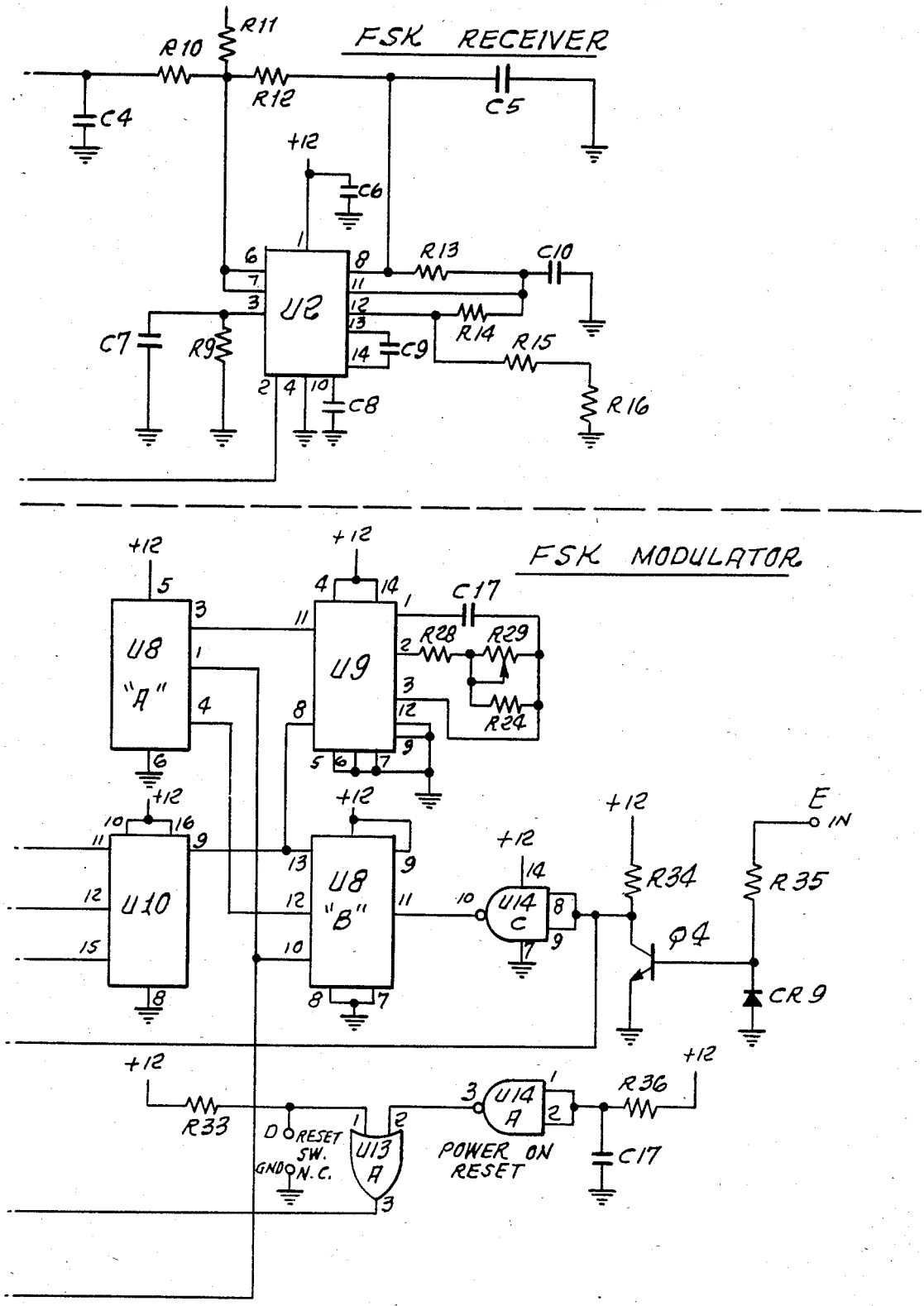
Figure 5:
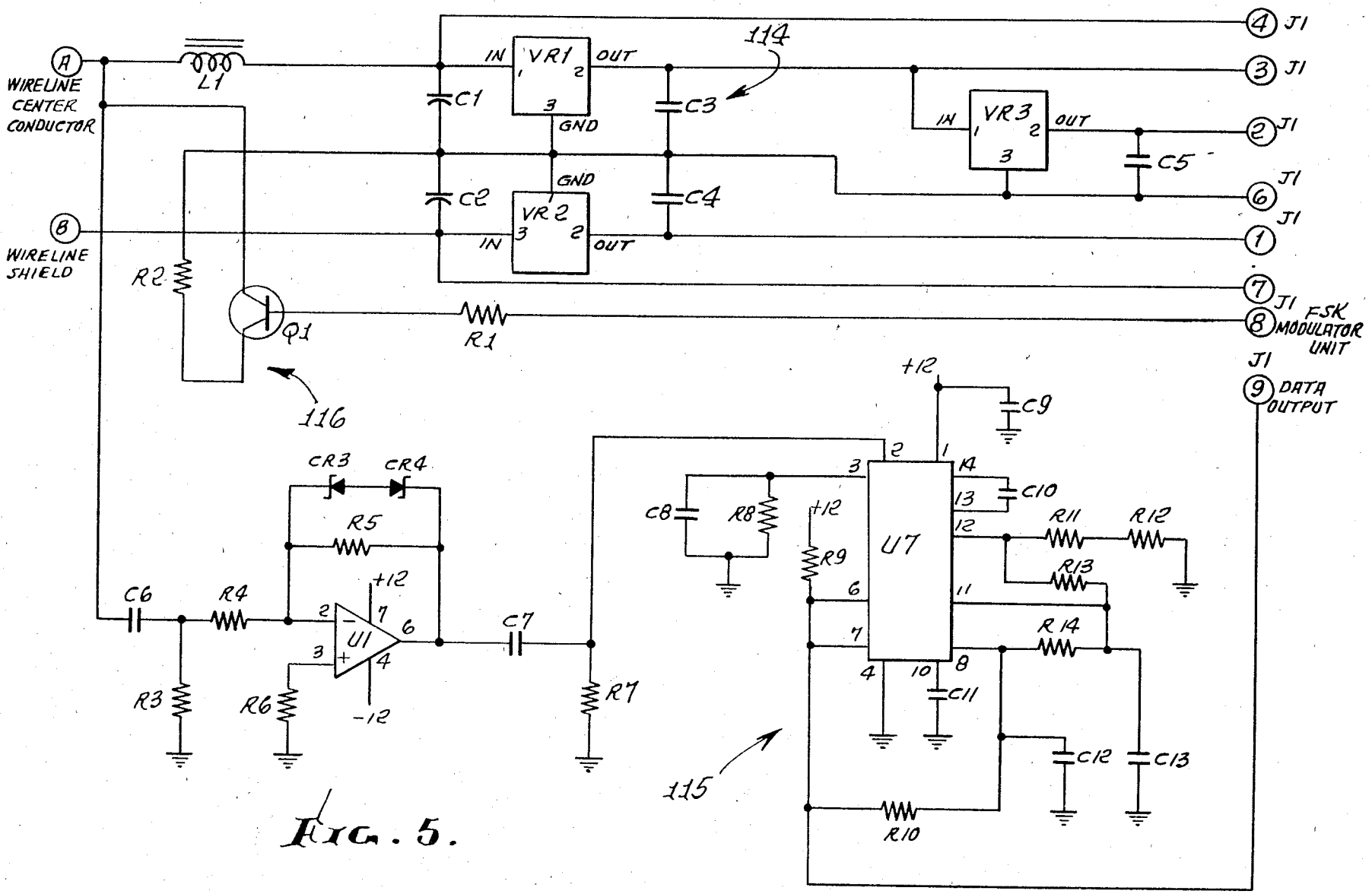
Figure 6A:
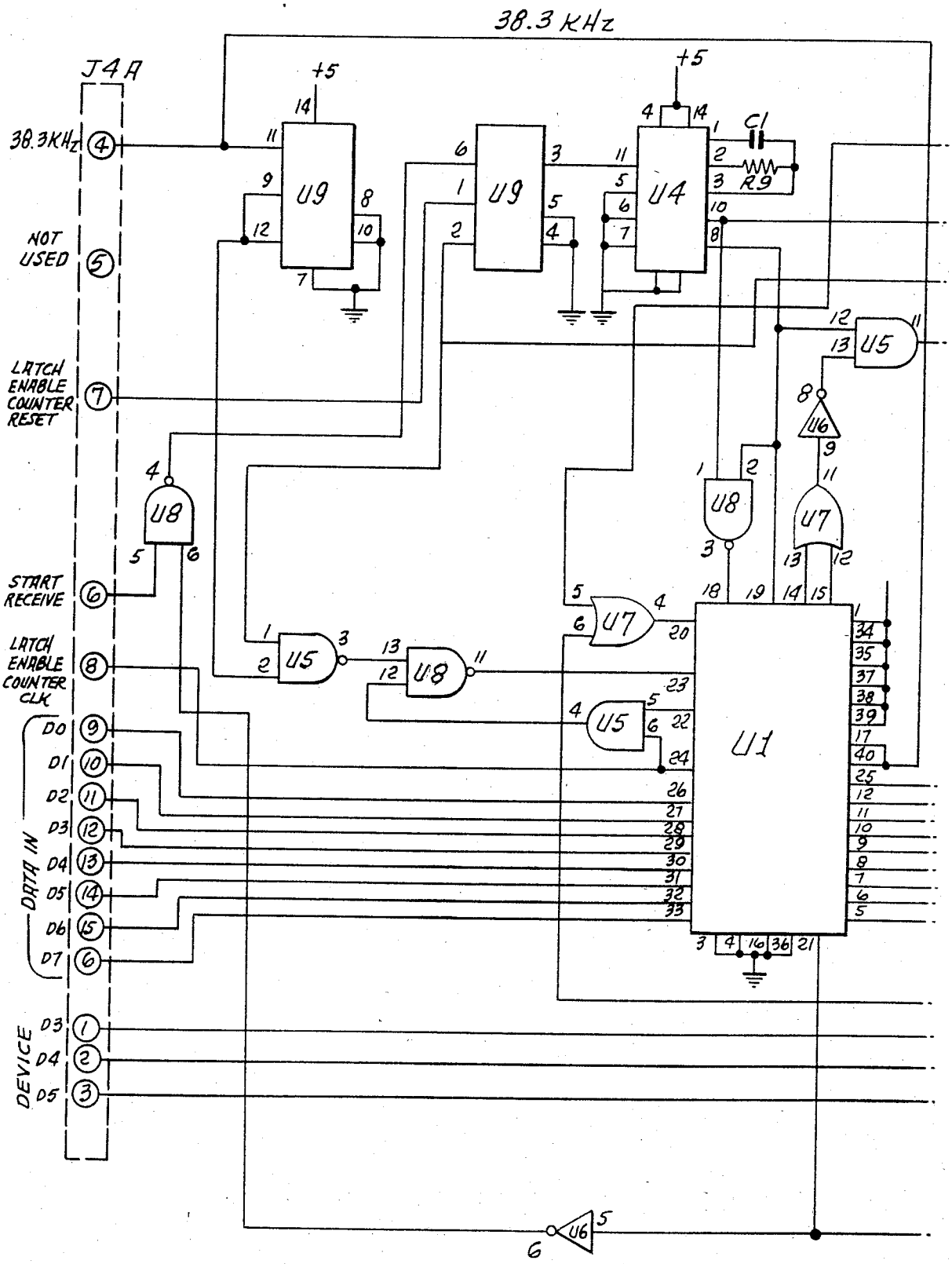
Figure 6B:
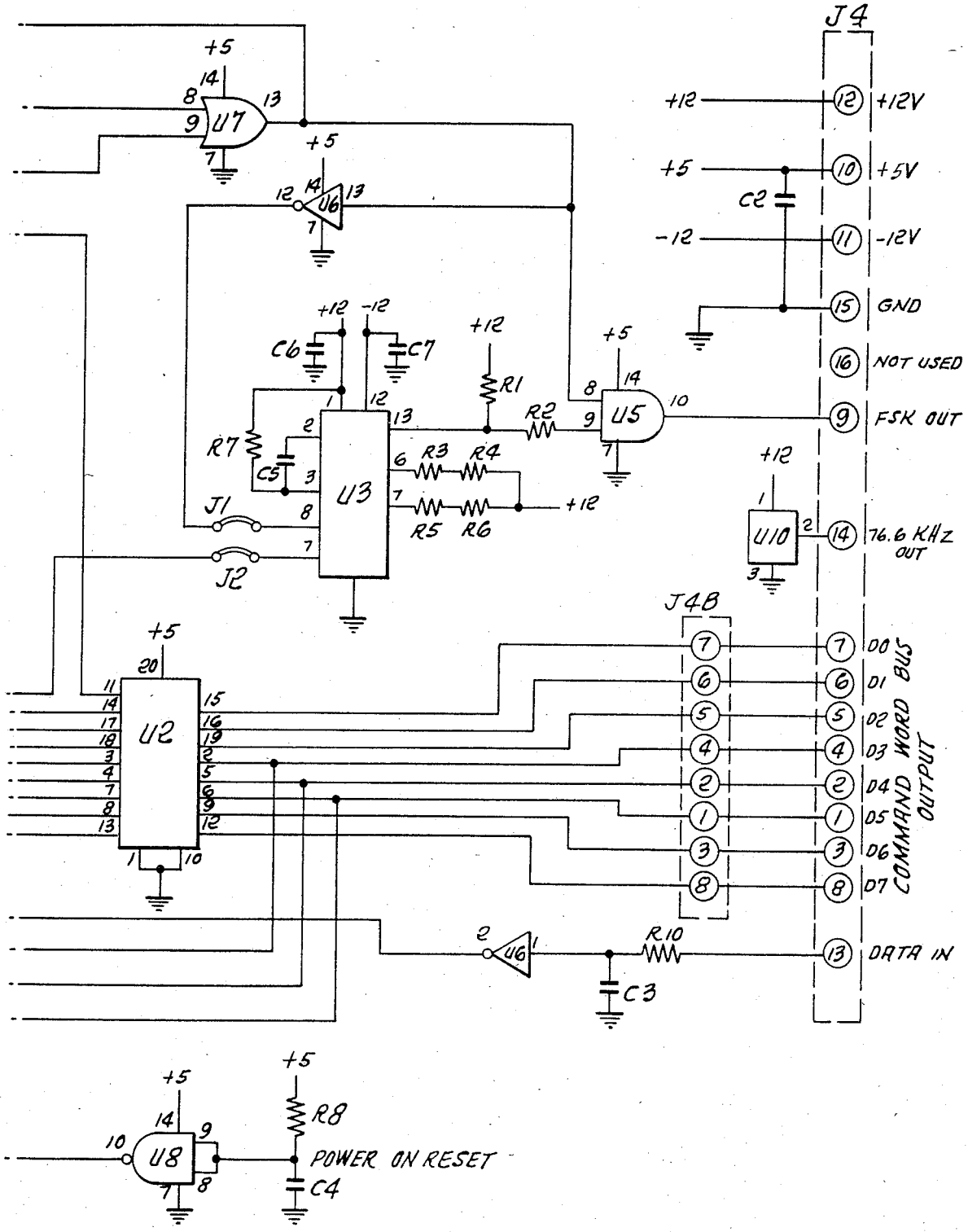
Figure 7:
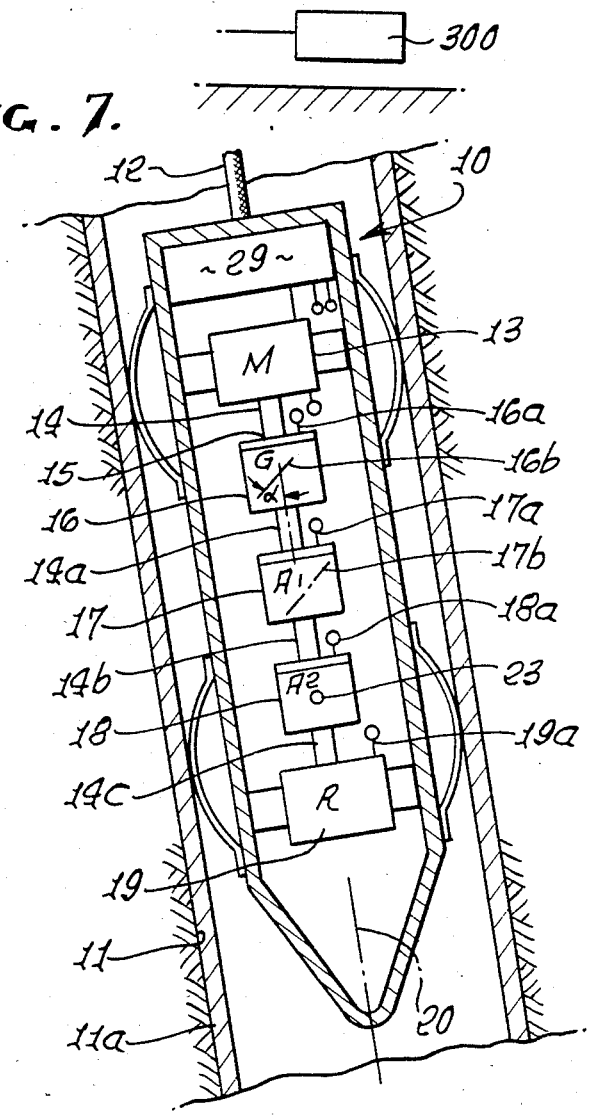
Figure 7:
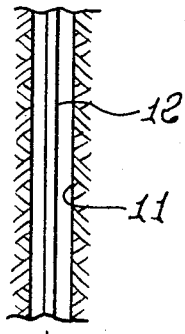
Figure 8:
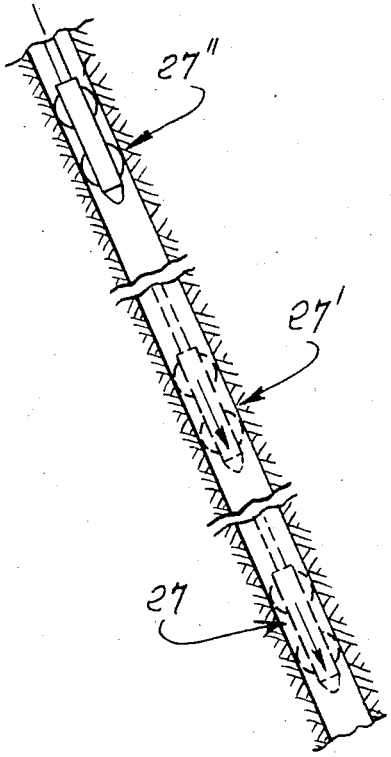
Figure 7A:
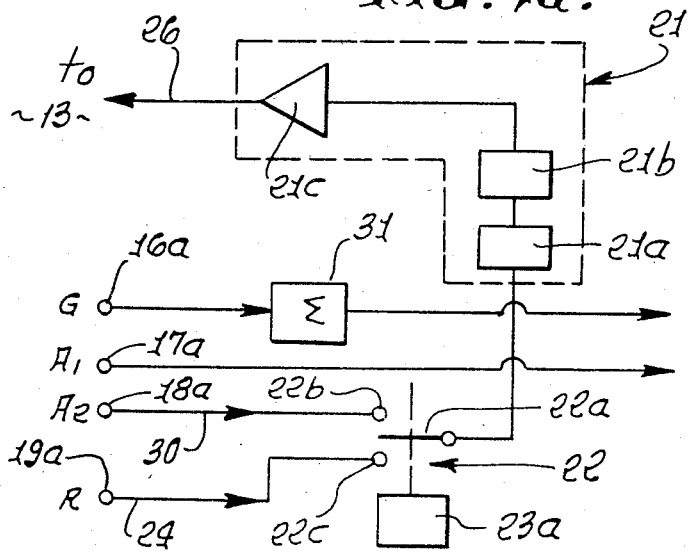

FIGS. 4*a* and 4*b* show details of FSK receiver and modulator blocks employed in FIG. 1, and also an uphole power supply;

FIG. 5 shows details of FSK receiver power supply;

FIGS. 6*a* and 6*b* show details of a communications board block shown on FIG. 1;

FIG. 7 is an elevation taken in section to show one form of instrumentation employing the invention;

FIG. 7*a* is a circuit schematic for gimbal control;

FIG. 8 is an elevation showing use of the FIG. 7 instrumentation in multiple modes, in a borehole; and FIG. 9 is a block diagram.

DETAILED DESCRIPTION

Referring to FIG. 7, a carrier such as elongated housing 10 is movable in a borehole indicated at 11, the hole being cased at 11*a*. Means such as a cable to travel the carrier lengthwise in the hole is indicated at 12. A motor or other manipulatory drive means 13 is carried by and within the carrier, and its rotary output shaft 14 is shown as connected at 15 to an angular rate sensor means 16. The shaft may be extended at 14*a*, 14*b* and 14*c* for connection to first acceleration sensor means 17, second acceleration sensor means 18, and a resolver 19. The accelerometers 17 and 18 can together be considered as means for sensing tilt. These devices have terminals 16*a*–*19a* connected via suitable slip rings with circuitry indicated at 29 carried within the carrier (or at the well surface, if desired).

Circuitry 29 typically may include a feed back arrangement as shown in FIG. 7*a* and incorporating a feed back amplifier 21, a switch 22 having arm 22*a* and contacts 22*b* and 22*c*, and switch actuator 23*a*. When the actuator closes arm 22*a* with contact 22*c*, the resolver 19 is connected in feed back relation with the drive motor 13 via leads 24, 25 and 26, and amplifier 21, and the apparatus operates for example as described in U.S. Pat. No. 3,753,296 to determine the azimuthal direction of tilt of the borehole at a first location in the borehole. See for example first location indicated at 27 in FIG. 8. Other U.S. Patents describing such operation are U.S. Pat. Nos. 4,199,869, 4,192,077 and 4,197,654. During such operation, the motor 13 rotates the sensor 16 and the accelerometers either continuously, or incrementally.

The angular rate sensor 16 may for example take the form of one or more of the following known devices, but is not limited to them:

1. Single degree of freedom rate gyroscope
2. Tuned rotor rate gyroscope
3. Two axis rate gyroscope
4. Nuclear spin rate gyroscope
5. Sonic rate gyroscope
6. Vibrating rate gyroscope
7. Jet stream rate gyroscope
8. Rotating angular accelerometer
9. Integrating angular accelerometer
10. Differential position gyroscopes and platforms
11. Laser gyroscope
12. Fiber Optic Gyroscope
13. Combination rate gyroscope and linear accelerometer Each such device may be characterized as having a "sensitive" axis, which is the axis about which rotation occurs to produce an output which is a measure of rate-of-turn, or angular rate $\omega$. That value may have components $\omega_1$, $\omega_2$ *and* $\omega_3$ in a three axis co-ordinate system. The sensitive axis may be generally normal to the axis 20 of instrument travel in the borehole, or it may be canted at some angle $\alpha$ relative to axis 20 (see canted sensitive axis 16*b* in FIG. 7).

The acceleration sensor means 17 may for example take the form of one or more of the following known devices; however, the term "acceleration sensor means" is not limited to such devices:

1. one or more single axis accelerometers
2. one or more dual axis accelerometers
3. one or more triple axis accelerometers Examples of acceleration sensors include the accelerometers disclosed in U.S. Pat. Nos. 3,753,296 and 4,199,869, having the functions disclosed therein. Such sensors may be supported to be orthogonal or canted ast someangle relative to the carrier axis. They may be stationary or carouseled, or may be otherwise manipulated, to enhance accuracy and/or gain an added axis or axes of sensitivity. In this regard the sensor 17 typically has two input axes of sensitivity. A canted axis of sensitivity is seen at 17*b* in FIG. 7. The axis of sensitivity is the axis along which acceleration measurement occurs.

The second accelerometer 18 may be like accelerometer 17, excepting that its input axis 23 is typically orthogonal to the input axes of the sensor 16 and of the accelerometer 17. During travel mode, i.e., lifting or lowering of the carrier 10 in the borehole 11, indicated at 27' in FIG. 8, the output of the second accelerometer 18 is connected via lead 30 (in FIG. 7*a*, contact 22*b*, switch arm 22*a*, and servo amplifier 21 to the drive motor 13). The servo system causes the motor to rotate the shaft 14 until the input axis 23 of accelerometer is horizontal (assuming that the borehole has tilt as in FIG. 8). Typically, there are two such axis 23 horizontal positions, but logic circuitry in the servo-system may for example cause rotation until the output of acceleration sensor 18 is positive. Amplifier 21 typically includes signal conditioning circuits 21*a*, feedback compensation circuits 21*b*, and power amplifier 21*c* driving the motor M shown at 13.

If, for example, the borehole is tilted 45° due East at the equator, acclerometer 17 would register +0.707 g or 45°, and the angular rate sensor 16 would register no input resulting from the earth's rate of rotation. If, then, the apparatus is raised (or lowered) in the borehole, while input axis 23 of accelerometer 18 is maintained horizontal, the output from accelerometer 17 would remain constant, assuming the tilt of the borehole remains the same. If, however, the hole tilt changes direction (or its elevation axis changes direction) the accelerometer 17 senses such change, the amount of such change being recorded at circuitry 29, or at the surface. If the hole changes its azimuth direction during such instrument travel, the sensor 16 senses the change, and the sensor output can be integrated as shown by integrator circuit 31 in FIG. 7*a* (which may be incorporated in circuitry 29, or at the surface) to register the angles of azimuth change. The instrumentation can be traveled at high speed along the tilted borehole while recording such changes in tilt and azimuth, to a second position (see position 27'' in FIG. 8. At that position, the instrumentation is again operated as at 27 (mode #1) to accurately determine borehole tilt and azimuth—essentially a re-calibration step. Thus, the apparatus can be traveled hundreds or thousands of feet, operating in mode

#2 as described, and between calibration positions at which travel is arrested and the device is operated in mode #1.

The above modes of operation are typically useful in the tilted portion of a borehole; however, normally the main i.e. lower portion of the oil or gas well is tilted to some extent, and requires surveying. Further, this part of the hole is typically at relatively high temperature where it is desirable that the instrumentation be moved quickly to reduce exposure to heat, the invention lending itself to these objectives. In the vertical or near vertical (usually upper) portion of the hole, the instrumentation can revert to mode #1 operation, at selected positions, as for example at 100 or 200 feet intervals. In a near vertical hole, azimuth contributes very little to hole position computation, so that mode #1 positions can be spaced relatively far apart, and thus this portion of the hole can be mapped rapidly, as well.

The operation of the survey tool as described above requires that the link for communications provide as a minimum:

1. Transmission of command signals from surface equipment 300 to the tool to change the mode of operation from the periodic measurement mode to the travel mode. This transition is controlled by switch 22 shown in FIG. 7*a*. To command the periodic measurement mode, switch 22 closes the contact 22*a* to 22*c* so that wire 24 from resolver contact 19*a*is connected to wire 25 and the servo control amplifier 21. To command the travel mode, switch 22 closes contact 22*a* to 22*b* so that the signal from accelerometer A2, 18, available at contact 18*a* is connected through wires 30 and 25 to the servo amplifier 21.

2. Transmission of data signals from gyroscope G, 16, and accelerometer A1, 17 to the surface.

Other useful and desirable command signals that may be transmitted from the surface to the survey tool at the lower level in the borehole include:

1. Commands to change the electronics gains, frequency response and scaling of elements of the electronics, 29, associated with accelerometer A1 and gyroscope G.

2. Commands to change the timing and number or positions, used in the periodic measurement mode of operations such that survey time and accuracy can be optimized by using longer dwell times when disturbances are present and shorter times when there are no significant disturbances.

3. Commands to control power so that minimum power operation can be achieved. Such commands may control various heater operations and provide increased power capability to the gimbal control servo only when required for high load conditions. (See heater 105*a* in FIG. 1).

4. Commands to alter the selection and timing of data to be transmitted from the survey tool to the surface. Such commands can be used to require the survey tool to provide specific responses to diagnostic test requests, and to send auxiliary data.

Other useful and desirable data that may be transmitted to the surface from the survey tool in the borehole include:

1. The output of the resolver, 19, on the gimbal axis;

2. Multiple temperature signals from points within the survey tool; (see temperature sensor 299 in FIG. 1).

3. Diagnostic data such as various power supply voltages or control electronics responses to stimuli received in commands from the surface;

4. Mode response signals to assure that the survey tool has received commands from the surface and is operating in the mode commanded.

The required transmission paths for signals from the surface to the survey tool and from the survey tool to the surface can be provided by a variety of methods. Such methods include:

1. Multiconductor (more than 2) wirelines with separate paths for various signals and commands;

2. Two conductor wirelines in which the bi-directional paths are carried by the same pair of wires. In this case, as in the case of multiple conductor wirelines, power to operate the survey tool may also be supplied over the same conductors as those used for data and command transmission;

3. Electromagnetic transmission through the earth between the surface and the survey tool;

4. Transmission of acoustic pressure waves through the drilling fluids in the borehole. Such waves may be created by throttling valves of various design that modulate the fluid flow.

5. Tranmission by modulation of light waves carried by a fiber optic element in the borehole. Such a fiber optic element may, or may not, be associated with one of the wireline approaches described above.

For almost all of the transmission approaches described above, some means of multiplexing the transmission path is required to control the bi-directional transmission so that they do not interfere with each other. Methods which may be used include:

1. Frequency Division Multiplexing
2. Time Division Multiplexing
3. Pulse position Multiplexing In addition to the problem of multiplexing the transmission path for the bi-directional transmissions, further multiplexing is generally required to accomodate the multiple commands or data required for transmission in each direction.

For purposes of illustrating one particular embodiment of a two-way communication system for a high speed survey tool, a system is described which selects from the above options:

1. A two conductor wireline also carrying DC power as the transmission path.

2. Time division multiplexing of the transmission path such that the surface equipment transmits one command word downwardly to the survey tool and the survey tool responds by transmitting the commanded data words upwardly to the surface equipment.

3. Both command and data words are transmitted as serial digital words in a bit-by-bit serial form using the standard RS232 format for serial digital data.

4. The serial digital bit stream is encoded onto the wireline by frequency shift keying (FSK) such that a digital one bit is represented by one carrier frequency and a digital zero bit is represented by another carrier frequency.

Referring now to FIG. 1, analog voltages from the tool sensors and electronics are supplied on leads 112 to the analog data converter board 103 for multiplexed analog to digital conversion. Also, the analog output signals of the angular rate sensor G, 16 and the first acceleration sensor A1, 17 are supplied on leads 113 to the V/F (Voltage-to-frequency) converter board, 104 for conversion to digital representations of the time integral of each signal. The integration and conversion of signals within board 104 are carried out by well-known means by using a voltage-to-frequency converter and a digital counter. Within board 103, the analog signals are multiplexed in time sequence and converted to digital output by a well-known successive approximation register parallel output analog-to-digital converter. The outputs at boards 103 and 104 are available to the digital tool data bus, 110, and are placed on the bus and presented to the communications board, 102, at the times that that board wishes to receive such data. Also, the communications board, 102, has a digital command bus, 111, by which it can transmit command data to tool modules such as diagnostic circuits, 105, the gimbal control servo, 106, the gyro loop board, 107, and the gyro wheel supply, 108. Any other module or board that is to receive command data can be connected to the same bus, 111. When the communication board, 102, has command data for any board or module, the communications board places the command data on the bus and addresses the proper module to read its command from the bus. Thus the communications board can transmit any command that it has received from the surface equipment to the proper module. See equipment 300 in FIG. 7.

The remainder of FIG. 1 shows the exchange of data and commands between the communications board 102, and the surface computer, 155. Since, as previously stated, this particular embodiment of a two-way communications system uses time division multiplexing to control the bi-directional transmission the process begins with a command generated by the computer, 155. Such command may be for example a request for data from the survey tool or a mode of operation command. Such computer command is sent to the uphole computer interface, 150, in a standard RS232 format over leads 156. Within the uphole computer interface, 150, the serial command is converted to a frequency-shift-keyed (FSK) modulation and placed on lead 141 which is connected to the inner conductor of a two-conductor wireline. The outer conductor, 144, of the wireline serves as a ground signal return path. Also connected to lead 141 through inductor L2, 150, and lead 157 is the uphole power supply 146 that provides a direct current power supply to the survey tool. Inductor L2 blocks the FSK signal from the power suppy so it must flow through the wireline to the survey tool. At the survey tool end of the wireline the combined FSK signal arrives at inductor L1, 109, and lead 158. The direct current power supply output goes through L1, 109 and lead 110*a* to the power supply—FSK receiver for use in generating secondary power supply levels. The FSK signal is blocked by inductor L1, 109, and thus enters the power supply—FSK receiver, 100 via lead 158. Within the power supply—FSK receiver module, the command signal is converted from FSK format to a serial digital signal at CMOS voltage levels for transmission of the command to the communications board, 102, by means of lead 101*a*. Since it was assumed that the command was a request for data, the communications board gates in the commanded data from the digital data bus, 110, and combines it in the desired serial form, converts it to FSK, and returns it to the power supply—FSK receiver, 100 by lead 101*b*. The FSK signal is used to modulate a current flowing in lead 158 which is connected to the wireline lead 141. Again, since inductor L1 and inductor L2, 109 and 150 respectively, block the FSK signal current, it must flow into the uphole computer interface, 150. Within 150 the FSK signal is converted to a standard RS232 serial interface signal and transmitted to the computer, 155, by means of lead 156. Since the computer, 155, initiated the total sequence by requesting data, the computer has been waiting for data to return, and therefore recognizes the data stream as the response to its requests and uses the data as the computer program specifies. When the returning data includes multiplexed A/D converter data, bits are included in the received message to identify which data is in each such word.

Another function for the uphole computer, 155, is to control or adjust the uphole power supply, 146. This is done by the computer generating a power control signal which is sent to the uphole computer interface, 150, by the RS232 digital interface connection 156. The uphole computer interface, 150, in turn converts the power control signal to the form required by the uphole power supply, 146. This control signal is transmitted by lead. The uphole power supply, 146, uses this input signal on lead 147 to adjust the output voltage or current at lead 157 to the desired valve.

Figure 2:
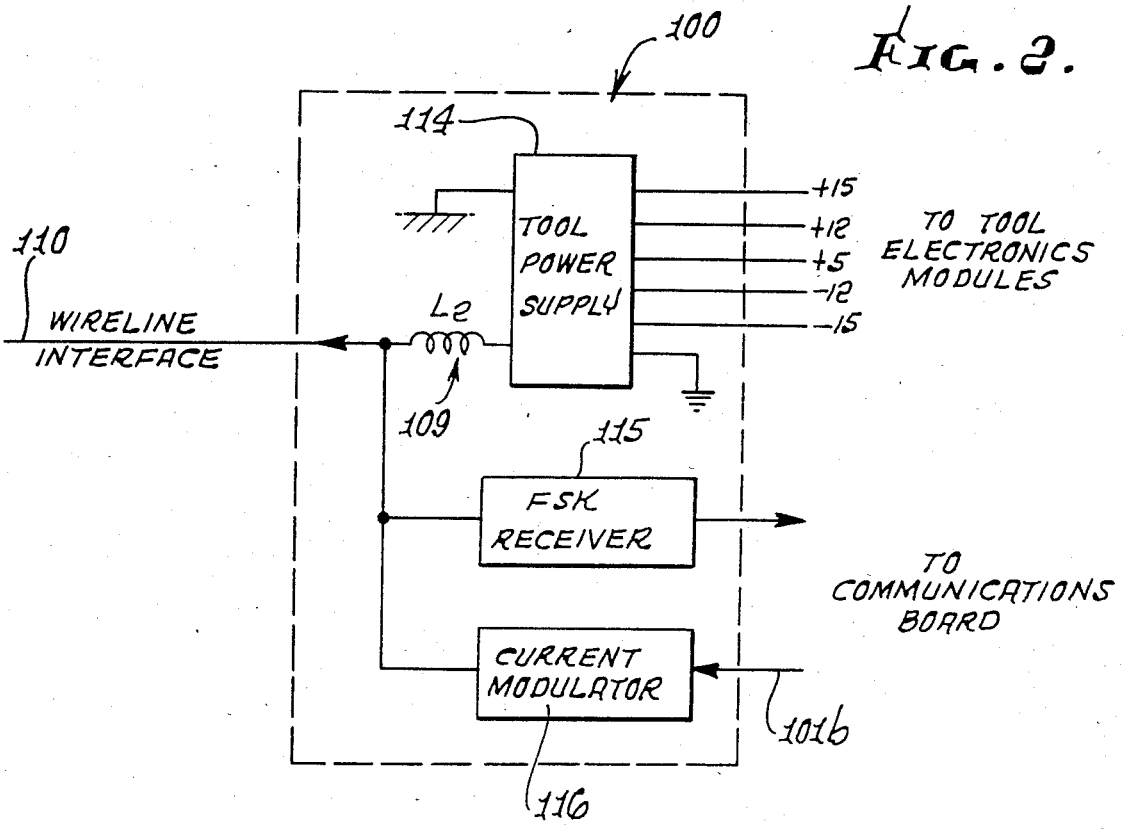
FIG. 2 is a circuit block drawing of the power supply—FSK receiver as shown in FIG. 1.
Figure 3:
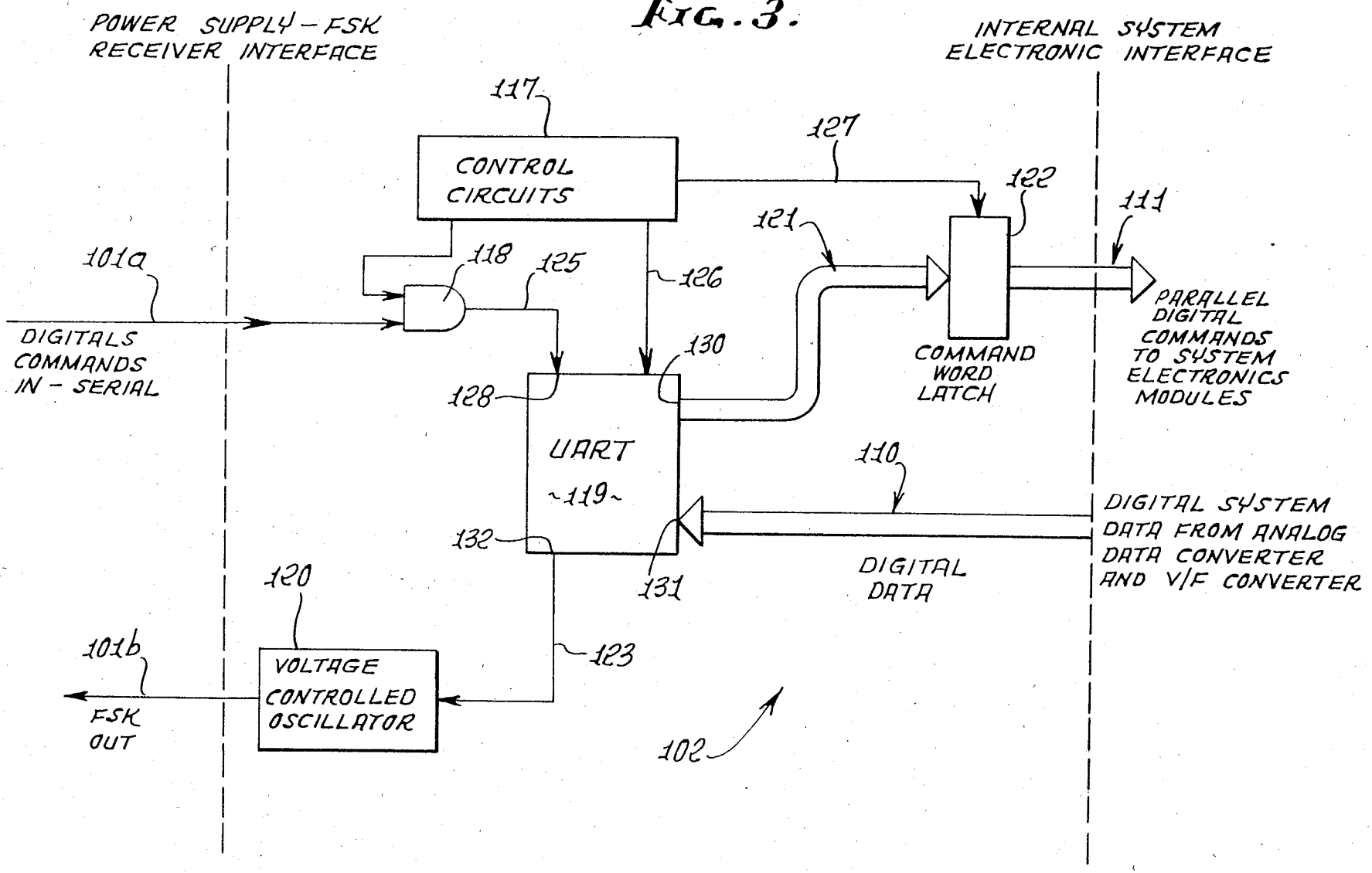
FIG. 3 is a circuit block drawing of the communications board as shown in FIG. 1.

FIG. 2 shows a block diagram of the power supply—FSK receiver, 100, and FIG. 5 shows a schematic of it. Block 114 is the tool power supply and is of conventional design. The FSK receiver, 115 is a type XR -2211 FSK Demodulator/Tone Decoder manufactured by EXAR, Inc., Sunnyvale, California. The current modulator 116 is a single high-voltage transistor controlled by the signal input on line 101*b*. FIG. 3 shows a block diagram of the communications board, 102, and FIG. 6 is a schematic of it. Control circuits, 117 generate the timing and control signals 118, 126, and 127 that control the communications process. The principal components other than the control circuitry are the UART, (Universal asynchronous receiver transmitter) 119, the command word latch, 122, and the voltage controlled oscillator, 120. The UART, of type 6402 manufactured by Harris Semiconductor Inc., Melbourne, Fla., can, under control of signals 126, accept a serial input at 128 from lead 125 to provide parallel outputs at 130 on bus 121 or accept parallel inputs at 131 on bus 110 and provide a serial output at 132 on lead 123. When serial inputs are to be accepted at 128, the gate, 118 is enabled so that the signal on lead 101*a* may be coupled to lead 125. When control circuits activate lead 127 to the command word latch , 122, the input data which has passed from serial input at 128 to parallel output at 130 and via bus 121 are coupled to the output digital command bus 111 and held there until a subsequent command is received.

When digital data is to be transmitted to the surface, the control circuits, 117, initiate actions that cause successive parallel digital data words to be presented on the digital tool data bus, 110, which are in turn inputted to the UART at 131 and then outputted from the UART in serial form at 132 for transmission by lead 123 to the voltage controlled oscillator, 120. The voltage controlled oscillator may be an XR -2207 manufactured by EXAR, Inc., of Sunnyvale, Calif. The voltage controlled oscillator provides a frequency-shift-keyed, FSK, output at 101*b* which is modulated onto the wireline current by the power supply—FSK receiver, 100 and outputted on lead 158 as previously described to the wireline, 141, and the uphole computer interface, 150.

FIG. 4 is a schematic of the uphole computer interface 150. It contains an XR -2207 and and XR -2211 to perform the same functions as they do in the power supply—FSK receiver, 100, and the communications board, 102.

Note also, in FIG. 1, the computer peripherals, indicated at 159.

FIG. 9 indicates, the provision of alternate or auxiliary transmission paths, both up and down, between surface equipment 300, as described, and down-hole equipment 301, as described. See for example equipments depicted in FIG. 1. The alternate transmission paths, indicated generally at 302, may take one of the following forms:

(a) means to propagate electromagnetic wave modulations (signals) through the earth between 300 and 301 (and using appropriate couplers or transducers 303 and 304 between 302 and 15, and between 302 and 100), (b) means to propagate light wave modulations (signals) along a fiber optics path 302 in the borehole between 300 and 301 (and using appropriate couplers or transducers 303 and 304 between 302 and 150, and between 302 and 100), (c) means to propagate acoustic pressure modulations through a drilling fluid path (indicated at 302) in the borehole between 300 and 301 (and using appropriate couplers or transducers 303 and 304 between 302 and 150, and between 302 and 150).

We claim:

1. In apparatus used in borehole mapping or surveying and including instrumentation for the determination of borehole azimuth and/or tilt, the combination comprising (a) means for suspending said instrumentation in the borehole, (b) said instrumentation operating to generate analog signals in the borehole, (c) means responsive to reception of said signals for multiplexing said signals and converting same to digital signals, in the borehole, (d) means responsive to reception of said digital signals for converting said digital signals to digital signal words, (e) means in the borehole connected to receive said signal words and produce signal versions thereof for transmission to the surface, (f) a transmission path operatively connected with said (e) means, for transmitting said signal versions upwardly in the borehole, (g) means for stripping said signal versions off the transmission path at an upper elevation and processing said signal versions to a form usable in determination of borehole azimuth and/or tilt at the level of said instrumentation in the borehole, (h) means to generate digital command words, (i) means at an upper location connected to receive said digital command words and produce signal versions thereof for transmission downwardly in the borehole, to said instrumentation, (j) a transmission path for transmitting said command signals to the survey tool, (k) means for stripping said command signal versions off the (j) transmission path and processing said signal versions to form usable command words for use by said instrumentation in the borehole to control operating modes and other operating characteristics of said instrumentation.

2. The combination of claim 1 wherein said subparagraphs (f) and (j) transmission paths comprise a two conductor wireline in the borehole connected to transmit DC voltage downwardly and electrical frequency shift keyed (FSK) signals both upwardly and downwardly in the borehole.

3. The combination of claim 2 in which the (e) and (i) means comprise FSK means to produce said signal versions as FSK signal versions, and including:

(1) mixer stages connected to superimpose said FSK signal versions onto the DC wireline voltage for said transmissions upwardly and downwardly in the borehole, (m) power supply means supplying DC power on said wireline downwardly in the borehole to said instrumentation via a sub-surface power supply regulator, (n) and said sub-paragraph (1) mixer stages and said (f) and (j) means including inductors operating to pass said DC power, but blocking said FSK signal versions from passing into said power supply means and into said sub-surface power supply regulator.

4. The combination of claim 1 wherein said (f) and (j) transmission paths are provided by means to propagate acoustic pressure modulations through the drilling fluids in the borehole, both upwardly and downwardly.

5. The combination of claim 1 wherein said (f) and (j) transmission paths are provided by means to propagate electromagnetic wave modulations through the earth between the surface and the instrumentation in the borehole.

6. The combination of claim 1 wherein said (f) and (j) transmission paths are provided by means to propagate light wave modulations along a fiber optic path in the borehole between the surface and the instrumentation in the borehole.

7. The combination of claim 1 wherein said instrumentation includes angular rate sensor means and acceleration sensor means which are operated to generate said analog signals of sub-paragraph (b).

8. The combination of claim 7 wherein said instrumentation includes temperature sensor means operated to generate analog signals of sub-paragraph (b).

9. The combination of claim 1 wherein said instrumentation includes pipe or tubing collar locater means operated to generate analog signals of sub-paragraph (b) and indicative of the presence or absence of such a collar at the instrumentation level in the borehole.

10. The combination of claim 1 including:

($N_1$) first sensor means for measuring angular rate about one or more axes, ($N_2$) second sensor means for sensing tilt or acceleration along one or more axes, ($N_3$) rotary drive means for rotating and controlling said first and second means in the borehole, and ($N_4$) circuit means operatively connected between said second means and rotary drive means for:

(i) allowing the drive to rotate the first and second means at a first location in the borehole to determine the azimuthal direction of tilt of the borehole at said location, and (ii) causing the drive to maintain an axis defined by said second means at a predetermined orientation relative to horizontal during traveling of the apparatus in the borehole, whereby at least one of the first and second means may be operated during such traveling to determine changes in borehole alignment along the borehole length.

11. The well survey method employing apparatus as defined in claim 1 and including first means for measuring angular rate, and second means for sensing tilt, and a rotary drive for the first and second means, the basic steps of the method including:

(a) operating the drive and the first and second means at a first location in the borehole to determine the azimuthal direction of tilt of the borehole at such location, (b) then traveling the first and second means and the drive lengthwise of the borehole away from that location, and operating the drive and at least one of the first and second means during such traveling to determine changes in borehole alignment during traveling, (c) said (a) and (b) steps carried out while the signal versions are passed upwardly and downwardly in the borehole.

* * * * *